US009497538B2

(12) United States Patent
Akino

(10) Patent No.: US 9,497,538 B2
(45) Date of Patent: Nov. 15, 2016

(54) VARIABLE DIRECTIONAL MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/795,452

(22) Filed: Jul. 9, 2015

(65) Prior Publication Data

US 2016/0021455 A1 Jan. 21, 2016

(30) Foreign Application Priority Data

Jul. 15, 2014 (JP) ..... 2014-145026

(51) Int. Cl.

| | |
|---|---|
| ***H04R 9/08*** | (2006.01) |
| ***H04R 1/32*** | (2006.01) |
| ***H04R 1/40*** | (2006.01) |
| *H04R 1/02* | (2006.01) |

(52) U.S. Cl.

CPC ..... *H04R 1/326* (2013.01); *H04R 1/40* (2013.01); *H04R 1/02* (2013.01)

(58) Field of Classification Search

CPC ..... H04R 1/02; H04R 1/083; H04R 1/38; H04R 1/406; H04R 19/04

See application file for complete search history.

(56) References Cited

U.S. PATENT DOCUMENTS 4,966,252 A * 10/1990 Drever ..... H04R 1/086 181/158
2006/0222196 A1* 10/2006 Uchimura ..... H04R 1/342 381/356
2013/0034256 A1* 2/2013 Akino ..... H04R 9/08 381/356

FOREIGN PATENT DOCUMENTS

JP 2000-50385 A 2/2000

* cited by examiner

*Primary Examiner* — Tuan D Nguyen
(74) *Attorney, Agent, or Firm* — Manabu Kanesaka

(57) ABSTRACT

A variable directional microphone includes a unidirectional microphone unit having a front acoustic terminal and a rear acoustic terminal; an acoustic tube which accommodates the microphone unit therein and having a plurality of acoustic resistance openings in a circumferential wall thereof; a supporting member mounted within the acoustic tube to be movable along an axis of the acoustic tube and supporting the microphone unit, the supporting member having a predetermined acoustic resistance and allowing transmission of sound waves; and further includes a gap formed between an outer circumferential wall of the microphone unit and an inner circumferential wall of the acoustic tube for providing communication between the front acoustic terminal and the rear acoustic terminal. Directionality of the variable directional microphone changes depending on the position of the microphone unit in the acoustic tube.

14 Claims, 5 Drawing Sheets

VARIABLE DIRECTIONAL MICROPHONE

RELATED APPLICATIONS

The present application is based on, and claims priority from, Japanese Application No. JP2014-145026 filed Jul. 15, 2014, the disclosure of which is hereby incorporated by reference herein in its entirety.

BACKGROUND OF THE INVENTION

Field of the Invention

The present invention relates to a variable directional microphone, the directionality of which can be switched from unidirectional to narrow directional and vice versa depending on an ambient noise level.

Description of the Related Art

In case of sound recording in an open-air environment, when an ambient noise level surrounding a targeted sound source is low, a unidirectional (such as a cardioid or a sub-cardioid directional) microphone is preferably used. In this case, high quality sound recording is possible while suppressing to record undesirable ambient sounds, even though there might be quality changes of sound depending on distance or the direction from the sound source.

In contrast, when the ambient noise level is high, use of a narrow directional microphone is preferred. In this case, the targeted sound wave can be surely recorded, even though there is considerable changes of sound quality depending on the distance or the direction from the sound source.

Thus, preferable directional characteristics of the microphones to be used are different depending on the surrounding condition. Therefore, a microphone the directionality of which can be switched from unidirectional to narrow directional and vice versa has been required; the microphone is operated as a unidirectional microphone when the ambient noise level is low, and operated as a narrow directional microphone when the ambient noise level is high. Particularly in news media, broadcasting with simple devices in comparison with the former ones becomes possible due to development of communication technologies. Therefore, live broadcasting can be more easily performed, which conventionally required large-scaled techniques. As for microphones in addition, it is convenient that the directionality of the microphone is easily switchable from unidirectional (a handy microphone case) to narrow directional (a shotgun microphone case) and vice versa, since consequently there is no need to prepare many kinds of microphones.

Japanese Patent Application Laid-Open (JP-A) No. 2000-50385 discloses a line microphone in which a unidirectional microphone unit is placed inside of a rear end side of an acoustic tube, and the microphone unit divides the acoustic tube into a front acoustic capacity room and a rear acoustic capacity room, and a rear sound-wave inlet-opening for a rear acoustic terminal of the microphone unit is additionally provided in the rear acoustic capacity room side.

In the above-said microphone, there is provided, on the area of the rear sound wave inlet-opening, a switching cover capable of varying the acoustic resistance of the rear sound wave inlet-opening, and switching the directionality to either hyper cardioid or cardioid, for example.

According to the microphone disclosed in the above referred patent application, the directionality can be switched between cardioid and hyper cardioid by changes of the acoustic resistance caused by variation of the area of the rear sound wave inlet-opening covered with the switching cover.

That is, by fully opening or fully closing the rear sound wave inlet-opening, predetermined directionality of cardioid or hyper-cardioid is instantaneously available, respectively.

To obtain intermediate directionality between the directionalities above, however, it is necessary to vary the area of the small rear sound wave inlet-opening by partially covering with the switching cover. Thus, it is difficult for users to vary the acoustic resistance of the rear acoustic terminal finely, adjustment of directionality is not easy.

SUMMARY OF THE INVENTION

The present invention has been made in view of the above-mentioned problems and an object of the invention is to provide a variable directional microphone, the directionality of which can be varied steplessly and easily by users themselves from unidirectional to narrow directional according to status of recording sound.

In order to solve the above problems, a variable directional microphone according to an aspect of the present invention includes a unidirectional microphone unit having a front acoustic terminal and a rear acoustic terminal; an acoustic tube accommodating the microphone unit therein and having a plurality of acoustic resistance openings in a circumferential wall thereof; a supporting member mounted within the acoustic tube to be movable along an axis of the acoustic tube and supporting the microphone unit, the supporting member having a predetermined acoustic resistance and allowing transmission of sound waves; and further includes a gap formed between an outer circumferential wall of the microphone unit and an inner circumferential wall of the acoustic tube for providing communication between the front acoustic terminal and the rear acoustic terminal.

The directionality of the variable directional microphone preferably changes depending on the position of the microphone unit in the acoustic tube.

In addition, the supporting member is preferably made of foamed material having air-permeability. And the supporting member is preferably elastic.

With this configuration, a user can move the microphone unit along the axis of the acoustic tube. With such operation, the directionality of the microphone can be changed steplessly from unidirectional to narrow directional, depending on the sound recording situation. The directionality of this structure is determined by the position of the microphone unit in the long acoustic tube and varied moderately from cardioid, that is, unidirectional to hyper-cardioid. Thus, the variable directional microphone of this structure enables users to obtain desired directionality of the microphone. For example, when recording sound, users can select the directionality of the microphone to be unidirectional if the ambient noise level is low, and select narrow directional if the ambient noise level is high.

In addition, the acoustic tube preferably includes a slit-like slide groove along the axial direction, and the microphone unit is movable along the slide groove.

Further, the microphone unit preferably includes a protrusion protruding from the slide groove, and the protrusion is configured to be movable so as to change the position of the microphone unit.

Further, elastic material members are preferably provided on both sides of the slide groove and sealed together, and the protrusion protrudes outward through the sealed portion of the elastic material members.

Thus, by moving the protrusion protruding from the slide groove of the acoustic tube, the position of the microphone unit can be changed, and accordingly the directionality can be easily varied from cardioid, that is, unidirectional to hyper cardioid.

There can be obtained a variable directional microphone wherein directionality of which can be varied steplessly and easily by users themselves from unidirectional to narrow directional according to status of recording sound.

DESCRIPTION OF THE PREFERRED EMBODIMENTS

Figure 1:
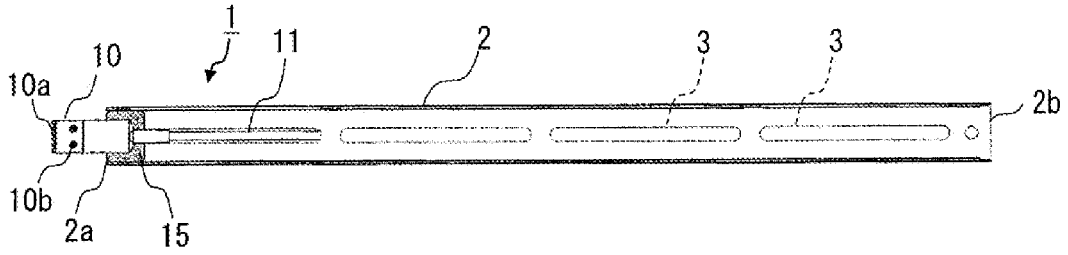
FIG. 1 is a cross-sectional view illustrating the structure of a variable directional microphone according to the present invention.
Figure 2:
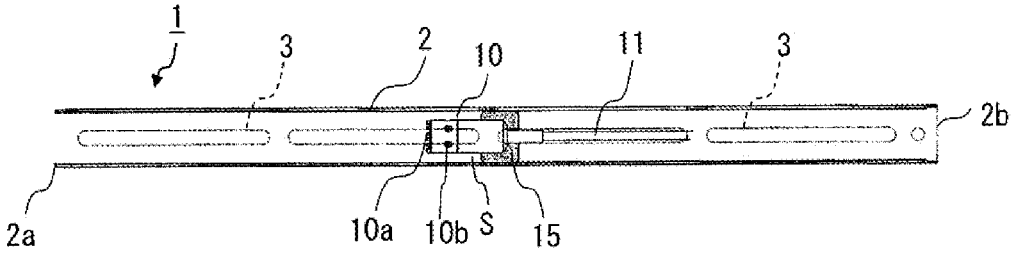
FIG. 2 is a cross-sectional view illustrating the structure of a variable directional microphone according to the present invention, showing a different setting of directionality from that shown in FIG. 1.
Figure 3:
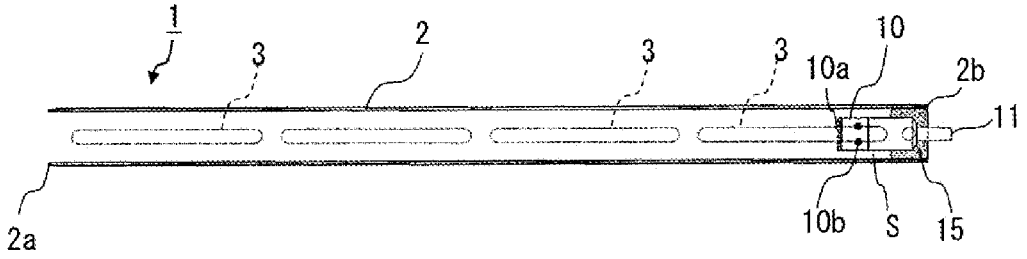
FIG. 3 is a cross-sectional view illustrating the structure of a variable directional microphone according to the present invention, showing a different setting of directionality from that shown in FIG. 1 or FIG. 2.

Hereinafter, embodiments of the invention will be described with reference to the accompanying drawings. FIGS. 1 through 3 are cross-sectional views illustrating a variable directional microphone according to the present invention. FIGS. 1 through 3 illustrate settings for different directionalities, a position of a microphone unit is different in each figure. A variable directional microphone 1 illustrated in FIG. 1 includes a cylindrical acoustic tube 2, a microphone unit 10 accommodated in the acoustic tube 2, and a supporting member 15 which supports the microphone unit 10 movably along the axial direction in the acoustic tube 2. The microphone unit 10 is a unidirectional microphone unit.

The acoustic tube 2 is a cylindrical body having a front end opening 2*a* and a rear end opening 2*b*. A plurality of acoustic resistance slit-based openings 3 are formed in the circumferential wall of the acoustic tube 2. Acoustic resistant material (not illustrated in the FIGS. 1 through 3), such as nylon cloth #508 manufactured by NBC Meshtec Inc., is attached to the acoustic resistant openings 3.

In addition, a front acoustic terminal 10*a* and a rear acoustic terminal 10*b* are provided on the front end side and on the rear end side of the microphone unit 10, respectively. Further, an electrical cable 11 is provided on the central part of the rear surface of the microphone unit 10 in order to take out sound signal, and is laid through the acoustic tube 2 and drawn out from the rear opening 2*b*.

The supporting member 15 also functions simultaneously as acoustic resistant material which allows sound waves to pass through, and therefore the supporting member is made of foamed material having air-permeability, such as sponge having continuous air bubbles. A predetermined air gap S is formed between the outer surface of the microphone unit 10 and inner circumferential wall of the acoustic tube 2, when the supporting member 15, for example, supports the microphone unit 10 in a manner illustrated in FIG. 2. Therefore, among sound waves coming into the acoustic tube 2, a sound wave coming from the rear side of the microphone unit 10 is collected from the rear acoustic terminal 10*b* after passing through the supporting member 15 and the gap S.

The supporting member 15 as set forth above is made of elastic material, such as spongy material. By applying an external force higher than a predetermined value to the supporting member 15, the supporting member 15 can be moved along the axis direction in the acoustic tube 2, so that the microphone unit 10 can be moved with the supporting member 15. The movement of the microphone unit 10 with the supporting member 15 can also be achieved by pulling out or pushing into the cable 11 along the axis direction of the acoustic tube. Such a moving method, however, may cause breaking of the cable. A method for pushing into the microphone unit 10 from the front end opening 2*a* or the rear end opening 2*b* of the acoustic tube 2 is desirably employed by using a pushing member or a thin rod, for example, (not illustrated).

Figure 4:
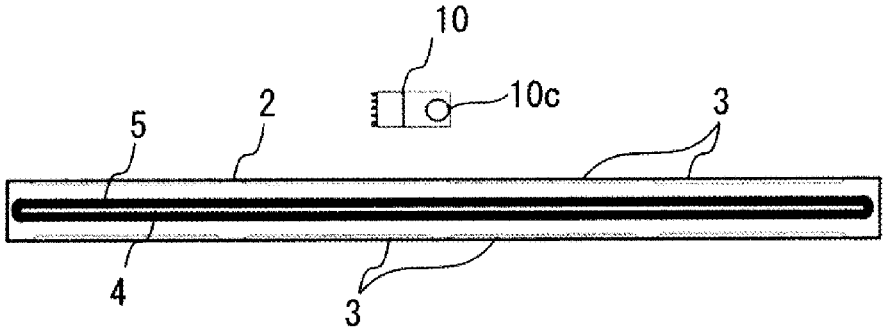
FIG. 4 is a disassembling view illustrating an example of a modified structure of a variable directional microphone according to the present invention.

Further, the slide groove 4 may be formed separately from the acoustic hole 3 on the circumferential wall of the acoustic tube 2 as shown in FIG. 4. The slide groove 4 is formed along the axis direction all over the acoustic tube 2. The microphone unit 10 has a protrusion 10*c* which is adapted to the slide groove 4 and is movable along the slide groove 4. On both sides of the slide groove 4, a sound insulating member 5 is provided, which is made of elastic material such as rubber, and sealed from both sides so as to hold the protrusion 10*c*. Consequently the protrusion 10*c* protrudes outward from the slide groove 4. The microphone unit 10 can be moved by holding the protrusion 10*c* as a knob. The sound insulating member 5 may be composed of a pair of pieces or one piece of elastic material. In case of one piece of elastic material, a slit is provided so that the protrusion 10*c* is movable. The slit is illustrated as an opening for explanation in FIG. 4, however, the actual slit is configured such that the sides of elastic member 5 on both sides of the groove are sealed together and insulates sound waves.

Thus, in the microphone 1, position of the microphone unit 10 can be changed by moving it together with the supporting member 15 in the acoustic tube 2.

Figure 5A:
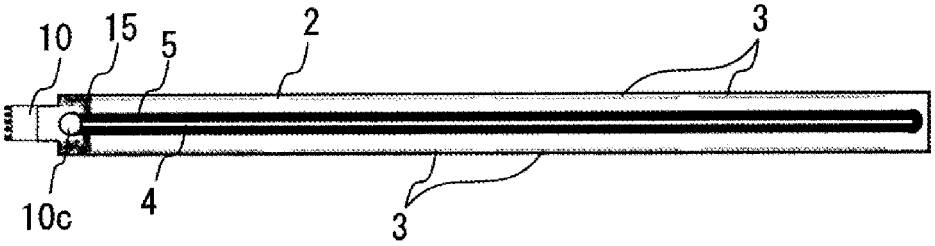
FIG. 5A is a cross-sectional views illustrating the structure of a variable directional microphone shown in FIG. 4, the directionality is set in the same way as that shown in FIG. 1.

As illustrated in FIG. 1, the front and rear acoustic terminals of the microphone unit 10 are in a state where the both terminals are exposed in the free space from the front opening 2*a* of the acoustic tube 2. For the configuration illustrated in FIG. 4, the usage state of the position of the microphone unit is as illustrated in FIG. 5A.

In this case, the microphone 1 works as a unidirectional microphone and sound recording is achieved with a cardioid directional characteristics when the ambient noise level is low.

Figure 5B:
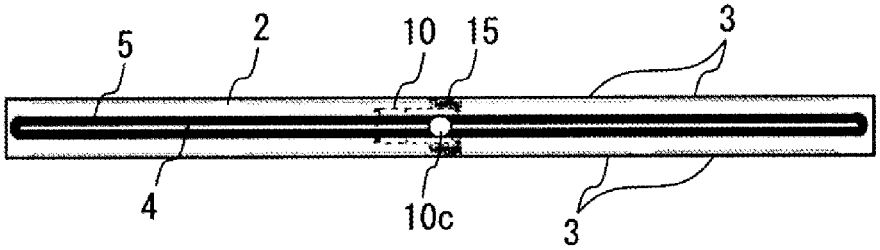
FIG. 5B is a cross-sectional views illustrating the structure of a variable directional microphone shown in FIG. 4, the directionality is set in the same way as that shown in FIG. 2.

Additionally, the directionality can be changed to unidirectional close to narrow directionality when the microphone unit 10 is moved to nearly the center of the acoustic tube 2 as illustrated in FIG. 2 or FIG. 5B.

Further, the directionality becomes narrow directional when the microphone 1 is moved to the rear end of the acoustic tube 2, as illustrated in FIG. 3, and then sound recording is achieved with a hyper cardioid directional characteristics.

Thus, according to embodiments of the present invention, users can move the microphone unit 10 along the axis in the acoustic tube 2. With this operation, the directionality can be varied steplessly from unidirectional to narrow directional in consideration of the situation of recording sound. The directionality which is determined by the position of the microphone unit 10 in the long acoustic tube 2 varies slowly from cardioid, that is, unidirectional to hyper cardioid. This enables users to set the microphone to desired directionality easily. For example, users can record sound with a unidirectional microphone when the ambient noise level is low, and a narrow directional microphone when the ambient noise level is high.

Moreover, in the above embodiment, supporting member 15 is formed of sponge having continuous air bubbles, but without limiting to sponge, other air-permeable material, such as non-woven fabric, can be used.

EXAMPLES

The microphone according to this invention is described in more detail with reference to examples.

In the examples, microphones illustrated in the description of the preferred embodiments were manufactured and the characteristics of the microphones were confirmed through the experiments for measurement.

Example 1

The directionality of the microphone according to the embodiments at the state shown in FIG. 1 is described.

Figure 6:
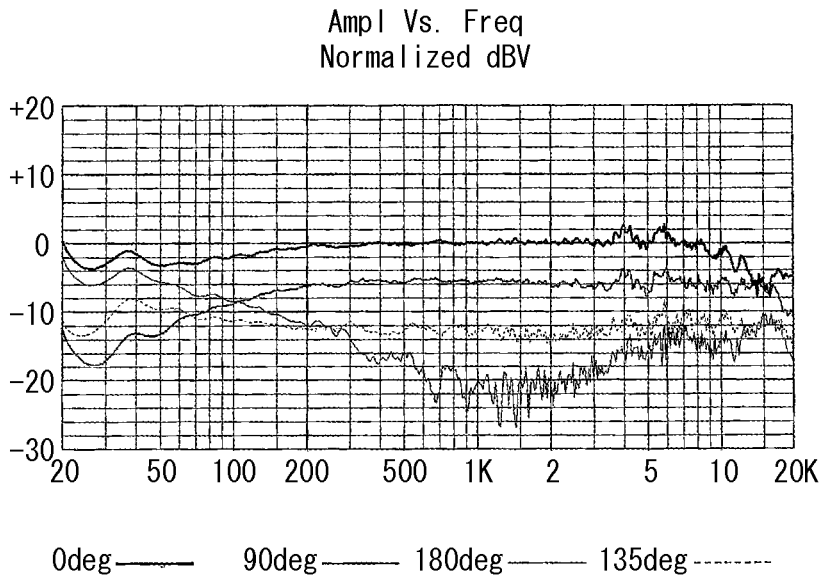
FIG. 6 is a graph showing directional characteristics measured at directions of 0 degree, 90 degree, 135 degree and 180 degree, for a setting of the variable directional microphone shown in FIG. 1.
Figure 7:
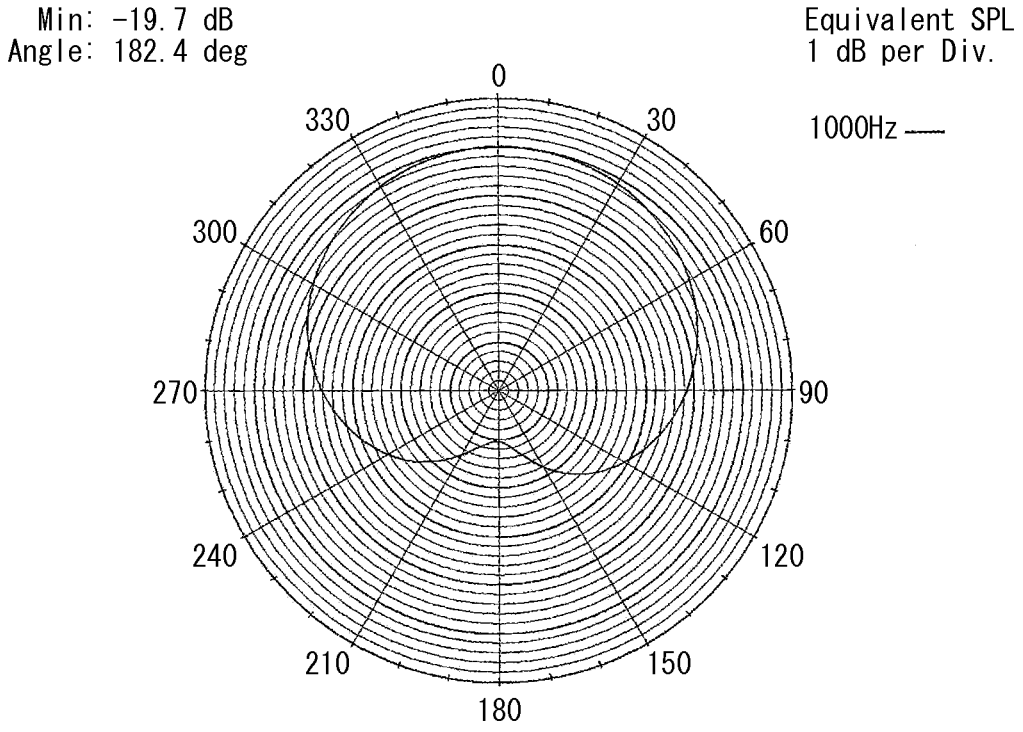
FIG. 7 is a polar pattern diagram for the directional characteristics shown in FIG. 6.

As shown in FIG. 1, a microphone unit was placed at the front end of an acoustic tube with the front and rear acoustic terminals of the microphone unit being exposed, and the directional characteristics was measured. FIG. 6 is a graph showing directional characteristics measured at directions of 0 degree, 90 degree, 135 degree and 180 degree, for a setting of the variable directional microphone. FIG. 7 is a polar pattern of the directional characteristics for the same setting as above. The directionality of the microphone was confirmed to be unidirectional, as shown in FIGS. 6 and 7.

Example 2

Figure 8:
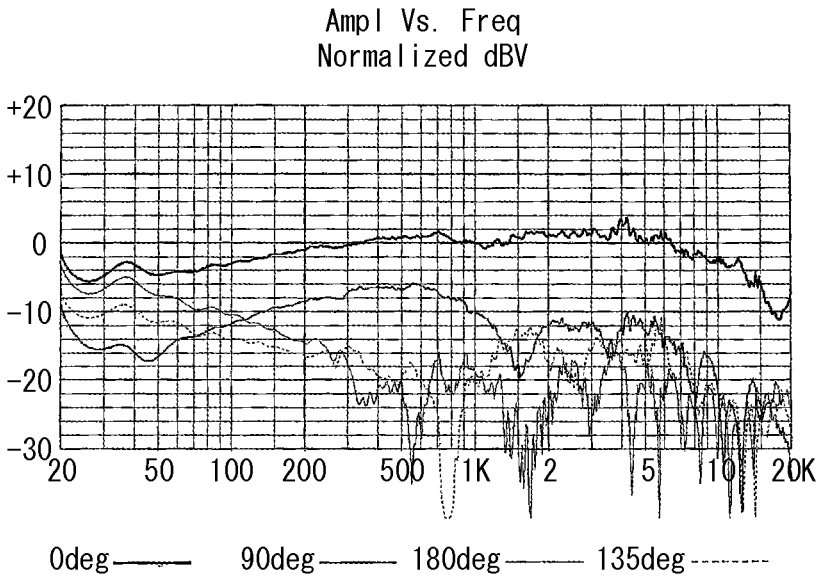
FIG. 8 is a graph showing directional characteristics measured at directions of 0 degree, 90 degree, 135 degree and 180 degree, for a setting of the variable directional microphone shown in FIG. 2.
Figure 9:
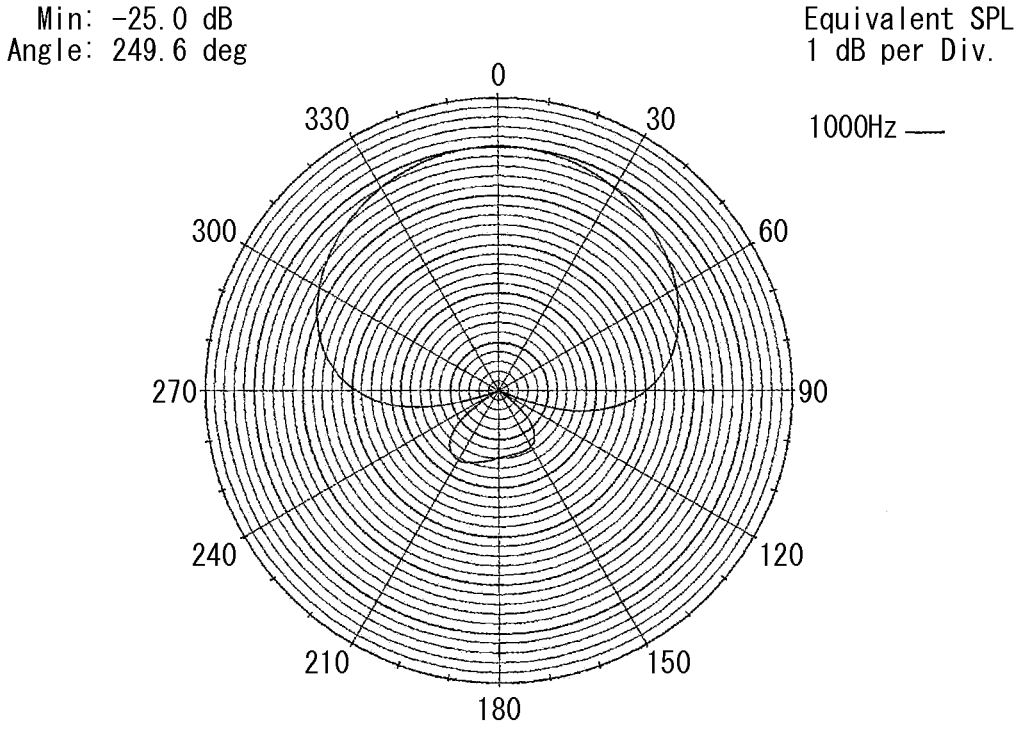
FIG. 9 is a polar pattern diagram for the directional characteristics shown in FIG. 8.

The directionality of the microphone according to the embodiments at the state shown in FIG. 2 is described. As shown in FIG. 2, a microphone unit was placed nearly at the center of an acoustic tube and the directional characteristics was measured. FIG. 8 is a graph showing directional characteristics measured at directions of 0 degree, 90 degree, 135 degree and 180 degree, for a setting of the variable directional microphone shown in FIG. 2. FIG. 9 is a polar pattern of the directional characteristics for the above setting. The directionality of the microphone was confirmed to be narrower directional compared with the Example 1, as shown in FIGS. 8 and 9.

Example 3

The directionality of the microphone according to the embodiments at the state shown in FIG. 3 is described.

As shown in FIG. 3, a microphone unit was placed at the rear end of an acoustic tube and the directional characteristics was measured.

Figure 10:
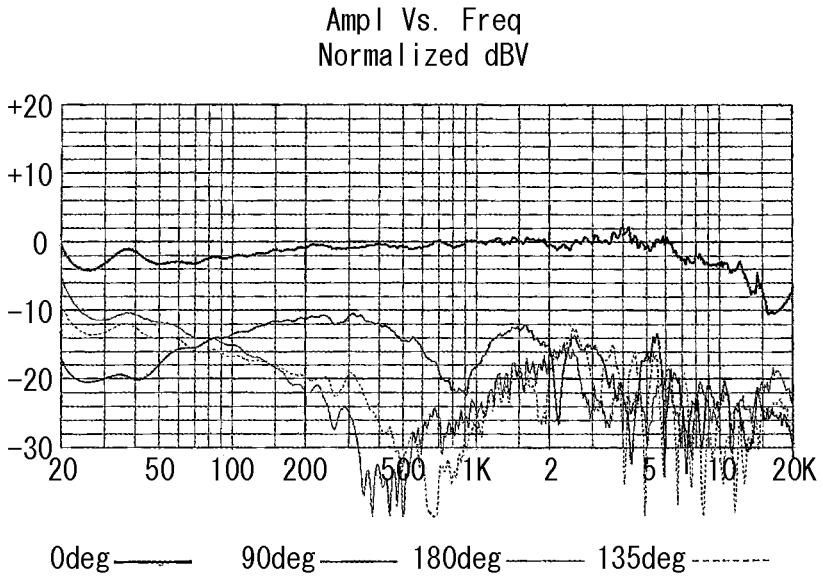
FIG. 10 is a graph showing directional characteristics measured at directions of 0 degree, 90 degree, 135 degree and 180 degree, for a setting of the variable directional microphone shown in FIG. 3.
Figure 11:
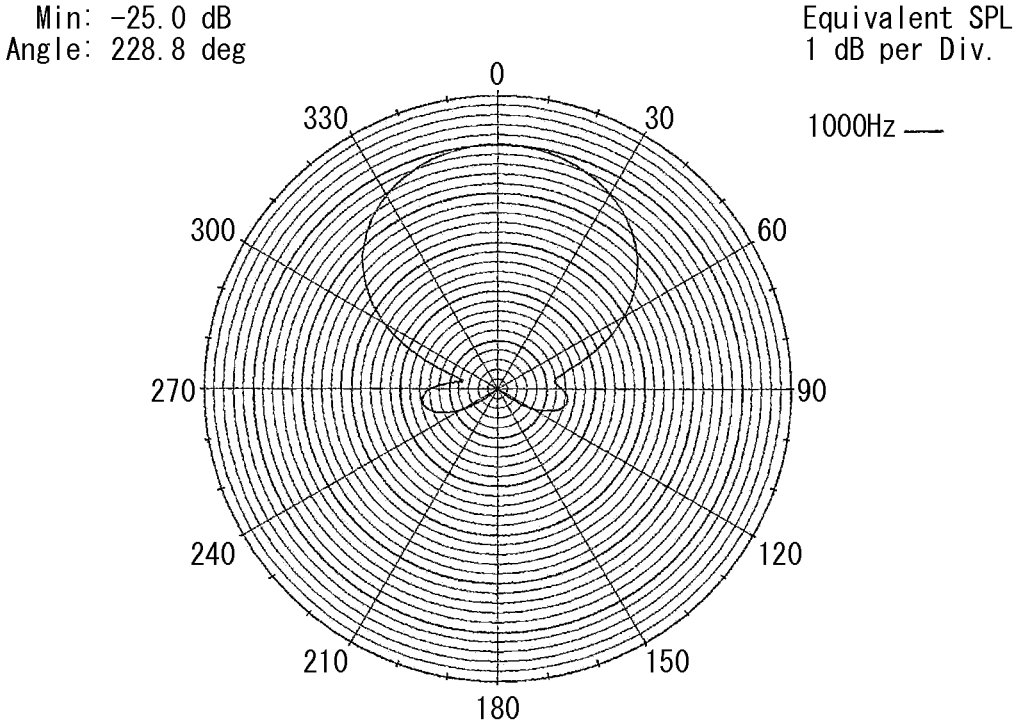
FIG. 11 is a polar pattern diagram for the directional characteristics shown in FIG. 10.

FIG. 10 is a graph showing directional characteristics measured at directions of 0 degree, 90 degree, 135 degree and 180 degree, for the setting, shown in FIG. 3. FIG. 11 is a polar pattern of the directional characteristics for the above setting. The directionality of the microphone was confirmed to be further narrower directional (hyper-cardioid) compared with the Example 2, as shown in FIGS. 10 and 11.

With the results of Examples 1 through 3, according to the present invention, the directionality of the microphone was confirmed to be easily changeable by users' adjusting the position of the microphone unit in the acoustic tube, depending on the situation of sound recording.

What is claimed is:

1. A variable directional microphone comprising:

a unidirectional microphone unit having a front acoustic terminal and a rear acoustic terminal;

an acoustic tube accommodating the microphone unit therein and having a plurality of acoustic resistance openings in a circumferential wall thereof;

a supporting member supporting the microphone unit within the acoustic tube and moving along an axis of the acoustic tube together with the microphone unit, the supporting member having a predetermined acoustic resistance and allowing transmission of sound waves; and a gap formed between an outer circumferential wall of the microphone unit and an inner circumferential wall of the acoustic tube for providing communication between the front acoustic terminal and the rear acoustic terminal.

2. The variable directional microphone according to claim 1, wherein the supporting member is made of foamed material having air-permeability.

3. The variable directional microphone according to claim 2, wherein the supporting member is elastic.

4. The variable directional microphone according to claim 3, wherein the acoustic tube further includes a slit-like slide groove along the axial direction, and the microphone unit is movable along the slide groove.

5. The variable directional microphone according to claim 4, wherein the microphone unit further includes a protrusion protruding from the slide groove, the protrusion is configured to be movable so as to change a position of the microphone unit.

6. The variable directional microphone according to claim 5, wherein elastic material members are provided on both sides of the slide groove and sealed together, and the protrusion protrudes outward through the scaled portion of the elastic material members.

7. The variable directional microphone according to claim 2, wherein the acoustic tube further includes a slit-like slide groove along the axial direction, and the microphone unit is movable along the slide groove.

8. The variable directional microphone according to claim 7, wherein the microphone unit further includes a protrusion protruding from the slide groove, the protrusion is configured to be movable so as to change a position of the microphone unit.

9. The variable directional microphone according to claim 8, wherein elastic material members are provided on both sides of the slide groove and sealed together, and the protrusion protrudes outward through the sealed portion of the elastic material members.

10. The variable directional microphone according to claim 1, wherein directionality changes depending on a position of the microphone unit in the acoustic tube.

11. The variable directional microphone according to claim 1, wherein the supporting member is arranged with the microphone unit in the acoustic tube such that a directionality of the microphone is unidirectional when the supporting member is placed at a front end of the acoustic tube with microphone unit, and the directionality of the microphone becomes narrower than that placed at the front end when the supporting member is placed at a rear end of the acoustic tube with the microphone unit.

12. A variable directional microphone comprising:

a unidirectional microphone unit having a front acoustic terminal and a rear acoustic terminal;

an acoustic tube accommodating the microphone unit therein and having a plurality of acoustic resistance openings in a circumferential wall thereof;

a supporting member mounted within the acoustic tube to be movable along an axis of the acoustic tube and supporting the microphone unit, the supporting member having a predetermined acoustic resistance and allowing transmission of sound waves; and a gap formed between an outer circumferential wall of the microphone unit and an inner circumferential wall of the acoustic tube for providing communication between the front acoustic terminal and the rear acoustic terminal, wherein the acoustic tube further includes a slit-like slide groove along the axial direction, and the microphone unit is movable along the slide groove.

13. The variable directional microphone according to claim 12, wherein the microphone unit further includes a protrusion protruding from the slide groove, the protrusion is configured to be movable so as to change a position of the microphone unit.

14. The variable directional microphone according to claim 13, wherein elastic material members are provided on both sides of the slide groove and sealed together, and the protrusion protrudes outward through the sealed portion of the elastic material members.

* * * * *